United States Patent [19]

Hauchard et al.

[11] Patent Number: 5,017,161

[45] **Date of Patent: * May 21, 1991**

[54] ELECTRIC TERMINAL CONNECTOR

[75] Inventors: Patrick Hauchard, Deville Les Rouen; Francois Loisel, Maromme, both of France

[73] Assignee: Legrand, Limoges, France

[ * ] Notice: The portion of the term of this patent subsequent to Nov. 13, 2007 has been disclaimed.

[21] Appl. No.: 368,045

[22] Filed: Jun. 19, 1989

[30] Foreign Application Priority Data

Jun. 21, 1988 [FR] France ..... 88 08293

[51] Int. Cl.[5] ..... H01R 4/18

[52] U.S. Cl. ..... 439/750; 439/879

[58] Field of Search ..... 439/738, 741, 750, 937, 439/879

[56] References Cited

U.S. PATENT DOCUMENTS

| | | | |
|---|---|---|---|
| 1,922,686 | 8/1933 | Johnson et al. | 439/738 |
| 2,964,171 | 12/1960 | Chadwick | 206/56 |
| 3,085,138 | 4/1963 | Brown et al. | 439/750 |
| 3,143,384 | 8/1964 | Senior, Jr. | 439/750 |
| 3,521,224 | 7/1970 | Spooren | 439/879 |
| 3,571,784 | 3/1971 | Naus et al. | 439/750 |
| 3,634,817 | 1/1972 | Wise | 439/937 |
| 3,774,141 | 11/1973 | Condon | 439/937 |
| 4,721,474 | 1/1988 | Kanno et al. | 439/750 |

FOREIGN PATENT DOCUMENTS

| | | | |
|---|---|---|---|
| 1468859 | 2/1967 | France . | |
| 2243534 | 4/1975 | France . | |
| 2277419 | 1/1976 | France . | |
| 2543369 | 9/1984 | France | 439/750 |
| 2579836 | 10/1986 | France . | |
| 7710656 | 4/1979 | Netherlands | 439/879 |

*Primary Examiner*—Gary F. Paumen

*Attorney, Agent, or Firm*—Charles A. Brown

[57] ABSTRACT

An electric terminal connector comprises a generally tubular metal part adapted to fit over the previously bared end of the conductive core of an insulated electric conductor. An insulative sleeve has a front portion adapted to be engaged with this metal part and a rear portion larger than the front portion adapted to fit over the corresponding end of the insulation of the electric conductor. The inner end of the metal part is initially straight and is deformed during manufacture into a tulip-shape having on its end surface an outside edge adapted to form an anchor edge by means of which it is anchored to the insulative part. The insulative part has a transverse shoulder with an inside diameter which is less than that of the inside edge of the end surface of the inner end of the metal part and the inner end of the metal part is aligned with the transverse shoulder.

8 Claims, 2 Drawing Sheets

ELECTRIC TERMINAL CONNECTOR

BACKGROUND OF THE INVENTION

1. Field of the Invention

The present invention is generally concerned with wiring accessories adapted to fit over the previously bared end of the conductive core of an insulated electric conductor in order to facilitate and render more secure the connection to a terminal of any kind, especially when the conductive core comprises multiple strands.

It is more particularly directed to wiring accessories usually referred to as electric terminal connectors comprising a generally tubular metal part adapted to fit over the previously bared end of the conductive core of the insulated electric conductor concerned and an insulative sleeve having a front portion engaged with the metal part and a rear portion larger than the front portion adapted to fit over the corresponding end of the insulation of the electric conductor.

2. Description of the Prior Art

One of the problems to be overcome in the manufacture of electric terminal connectors of this kind concerns the fastening together of the metal part and the insulative sleeve.

At present this is usually done by overmolding.

This is the case, for example, with the electric terminal connector which the subject matter of French patent 1 468 859 and published French patent application 2 277 419.

For anchoring it into the insulative sleeve the metal part has at the inner end a frustoconcial enlargement with both sides of which the synthetic material constituting the insulative sleeve is in contact.

Although this arrangement has proved satisfactory and may continue to prove satisfactory it has the following disadvantages.

Firstly, and most importantly, it is difficult to place the metal part in the mold for overmolding the insulative sleeve, which is detrimental to productivity and therefore to manufacturing cost.

In an electric terminal connector with the insulative sleeve overmolded in this way onto the metal part, if the molding interface between the insulative sleeve and the metal part is not properly controlled (and this is not necessarily a simple matter), the molding interface can constitute an obstacle to some strands of the conductive core to be inserted into the metal part and so block the strand or strands concerned. This represents an impediment to correct placing of the electric terminal connector currently being fitted, which may lead to its rejection, and (if the electric terminal connector is eventually fitted despite this difficulty) can lead to problems at a later stage, for example if the strands that were blocked project from the electric terminal connector or are broken off and escape from it. This is quite independent of the effect of any such blocking of strands on the electrical quality of the connection that results.

It has also been proposed to join the insulative part and the metal part of an electric terminal connector together by crimping.

This is the case, for example, in published French patent application 2 579 836 which is specifically concerned with an electric terminal connector and in U.S. Pat. No. 2,964,171, which is more specifically concerned with an eyelet-type wiring tag.

Following its insertion into the previously formed insulative part, the inner end of the metal part is deformed within the latter by expanding it so that its shape then matches the corresponding portion of the insulative part.

However, the corresponding deformation is limited to placing the inner end of the metal part worked on in this way against the relevant wall of the insulative part.

To facilitate such deformation the metal part is usually divided into separate tangs, as is the case in the aforementioned published French patent application.

The risks of blocking some strands briefly outlined hereinabove for assembly by overmolding are encountered in a similar way and even in an accentuated way with such assembly by crimping.

This effect is even more marked given that, as shown by experience, there occurs at the end of such crimping and by virtue of its inherent elasticity some degree of "rebound" of the previously crimped portion of the metal part relative to the insulative part, especially where, as mentioned above, the metal part is to this end divided into separate tangs, the more massive insulative part being relatively rigid in comparison with such tangs.

This "rebound" of the crimped portion of the metal part causes the latter in practise to project into the internal space of the insulative part, with the attendant risk of blocking some strands, which is best avoided.

Furthermore, the crimping force that has to be applied is relatively high, for example in the order of 35 kg for an electric terminal connector in which the metal part has a cross-section of 1.5 $mm^2$. In practise it is necessary to provide a backing member externally of the insulative part to absorb this force, which complicates the operation and is detrimental to the overall cost. It also further accentuates the stiffness of the insulative part relative to the metal part, accentuating the "rebound" which is best avoided.

A general object of the present invention is an arrangement for carrying out (or contributing to the carrying out of) the assembly of the insulative and metal parts of an electric terminal connector in a simple and effective way and without any resulting risk of blocking some strands.

SUMMARY OF THE INVENTION

The present invention consists in an electric terminal connector comprising a generally tubular metal part adapted to fit over the previously bared end of the conductive core of an insulated electric conductor and an insulative sleeve having a front portion adapted to be engaged with said metal part and a rear portion larger than said front portion adapted to fit over the corresponding end of the insulation of the electric conductor, in which connector the inner end of said metal part is initially straight and deformed during manufacture into a tulip-shape having on its end surface an outside edge adapted to form an anchor edge by means of which it is anchored to said insulative part, said insulative part has a transverse shoulder with an inside diameter which is less than that of the inside edge of said end surface of said inner end of said metal part and said inner end of said metal part is aligned with said transverse shoulder.

In practise the anchor edge penetrates the insulative part in the manner of a wedge.

Thus in accordance with the invention the metal part is anchored into the insulative part in a very simple way.

This anchoring differs from overmolding firstly in that the insulative part is made beforehand and the anchoring is performed after the insertion of the metal part into the insulative part and secondly in that when such anchoring is completed the material of the insulative part extends over one side only of the metal part and not over both sides thereof.

It also differs from crimping because it is not limited to merely placing the metal part against the insulative part, but instead achieves actual penetration of the metal part into the insulative part.

Like crimping, anchoring in accordance with the invention can advantageously be performed by expansion using a simple conical punch.

However, the force to be deployed is substantially reduced as compared with that necessary for crimping.

Other things being equal, this force is reduced by at least two thirds, for example from 35 kg to 10 kg for an electric terminal connector whose metal part has a cross-section of 1.5 $mm^2$.

One particular advantageous result of this is that it is no longer necessary to provide a backing member externally of the insulative part during such anchoring.

More importantly, there is no or virtually no "rebound" of the metal part after the anchoring is done.

In practise, if any such "rebound" occurs it is accompanied by corresponding movement of the insulative part.

As the latter has no backing member applied externally to it during the anchoring operation it also returns to its initial configuration due to its inherent elasticity and as this inherent elasticity is in practise intrinsically greater than that of the metal part it can even tend to move further than the latter.

In this case the insulative part grips the metal part around its anchor edge as well as this latter edge of the metal part penetrating the insulative part.

The risk of the metal part projecting into the interior space of the insulative part and therefore the risk of possible subsequent blocking of some strands is therefore advantageously minimized or even eliminated.

It has already been proposed, in published French patent application 2 243 534, to deform the inner end of the metal part of the connector concerned into a tulip-shape.

Initially, however, this inner end must be chamfered on both its inside and its outside, which cannot fail to increase the overall cost.

Also, the chamfered inner end of the metal part impinges on a straight portion of the inside surface of the insulative part, on which there is no shoulder.

Because a substantial part of the end surface of the inner end therefore continues to project relative to the inside surface of the insulative part there may remain a risk of blocking of some strands on inserting the previously bared end of the conductive core of an electrical conductor, even though this projecting part of this end surface is oblique.

This is not the case in the electric terminal connector in accordance with the invention in which, to the contrary, the deformed inner end of the metal part faces a transverse internal shoulder on the insulative part whose inside diameter is less than that of its own inside edge.

At the junction between the metal part and the insulative part, given the return of the latter to its initial configuration after anchoring of the metal part, the metal part is therefore recessed relative to the insulative part.

All risk of subsequent blocking of some strands is therefore eliminated.

Apart from the fact that the anchoring action in accordance with the invention has the advantage of not requiring any form of counter-recess on the insulative part, a particularly simple shape of the latter being perfectly satisfactory, the punch used to execute it has the advantage of causing some burring of the insulative part when it is inserted into it and of aligning the metal part perfectly with it, which further facilitiates the subsequent insertion of an electrical conductor into the assembly.

The anchoring action in accordance with the invention may be sufficient in itself for assembling the metal part of an electric terminal connector to its insulative part.

However, it can also and advantageously be associated with adhesive bonding when, as has been proposed elsewhere, a film of adhesive is operative between the metal part and the insulative part.

Its principal effect is then to significantly strengthen (by more than 20% in practise) the tensile strength of the assembly and to procure advantageously in all circumstances some degree of permanent resistance to traction even in the event of subsequent deterioration of the adhesive such as can occur through aging, for example.

Other things being equal, the anchoring action in accordance with the invention can also and advantageously make it possible to reduce the thickness of the film of adhesive employed.

In all cases it may be carried out before application of the adhesive or after it but before the adhesive is polymerized.

If it is carried out before application of the adhesive, it advantageously makes it possible to confine the film of adhesive employed by providing a seal at the inner end of the metal part and so opposing any penetration of the adhesive into the insulative part beyond the latter.

This advantageously avoids any internal spreading of glue likely to cause later any blocking of some strands.

The characteristics and the advantages of the invention will emerge from the following description given by way of example and with reference to the appended diagrammatic drawing.

DESCRIPTION OF THE PREFERRED EMBODIMENT

Figure 1:
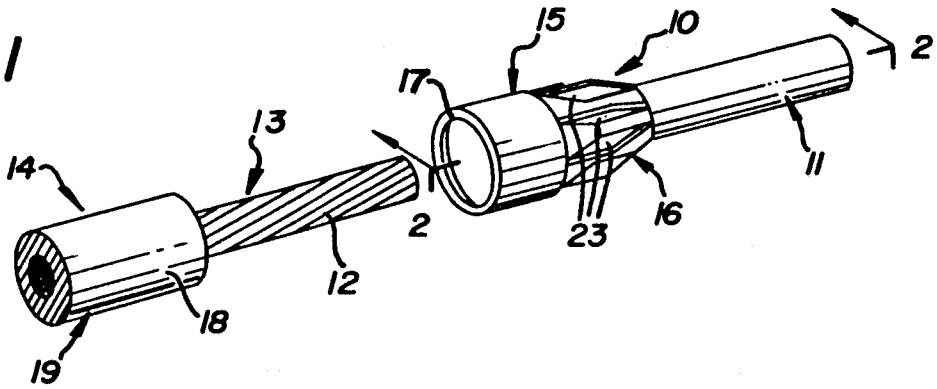
FIG. 1 is a perspective view of an electric terminal connector in accordance with the invention and the end of the conductor to which it is to be fitted.
Figure 2:
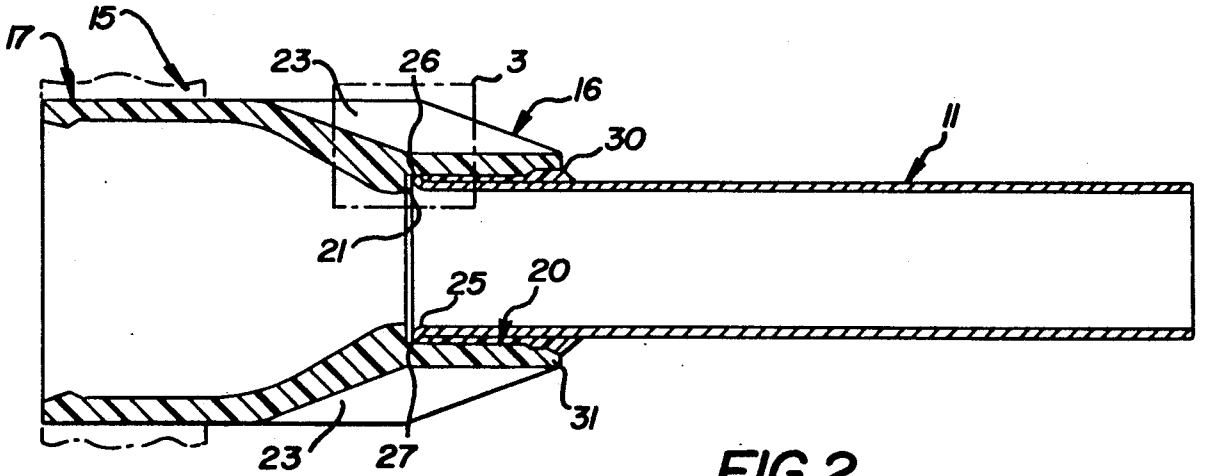
FIG. 2 is a view of the electric terminal connector in axial cross-section on the line II—II in FIG. 1 and to a larger scale.
Figure 3:
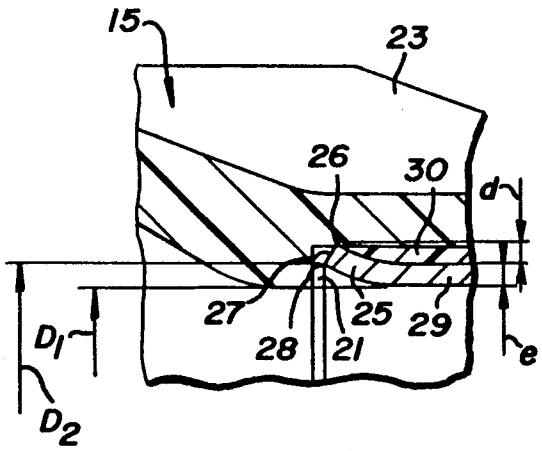
FIG. 3 shows to a larger scale the detail of FIG. 2 marked III in FIG. 2.

As shown in the figures, the electric terminal connector 10 in accordance with the invention comprises a generally tubular metal part 11 which is adapted to fit over the previously bared end 12 of the conductive core 13 of an insulated electric conductor 14 and an insulative sleeve 15 having a front portion 16 engaged with the aforementioned metal part 11, front portion 16 having an extreme distal end 31, and a rear portion 17, larger than the front portion 16, adapted to fit over the corresponding end 18 of the insulation 19 of the electrical conductor 14.

The metal part 11 is a globally cylindrical continuous tube with no discontinuity of any kind.

Obviously enough, however, this metal part could equally well be obtained by rolling an initially flat blank in which case it would have a longitudinal slit, straight or oblique, rectilinear or curvilinear and open or closed, for example by welding, and/or it could be more or less frustoconical, converging in the direction away from the insulative part 15.

The front portion 16 of the insulative part 15 is also globally cylindrical, forming an internal housing 20 delimited by a transverse shoulder 21. By virtue of provisions which are not relevant to the present invention and so will not be described in detail here, it is adapted to receive the metal part 11 within it, with clearance but centered, and it is joined externally to the associated rear section 17 by fins 23 regularly distributed in the circumferential direction and extending substantially radially. From the exterior contour of the rear section 17, they join the latter, these fins taper towards the outlet from the front section 16.

In accordance with the invention the inner end 25 of the metal part 11, which is initially straight, is globally deformed to a tulip-shape, widening radially away from the axis of the assembly, the outside edge 26 of its end surface 27 forming an anchor edge through which it is engaged with the insulative part 15.

By the inner end 25 of the metal part 11 there is meant in this instance the portion of this metal part immediately adjacent its end surface 27 and the outside edge 26 of this end surface 27 forms its largest diameter periphery.

The anchor edge that this outside edge 26 forms penetrates into the insulative part 15 in the manner of a wedge, to be more precise into the corresponding inside wall of the front section 16 of the insulative part 15.

The amplitude d of the radial offset of this outside edge 26 relative to the outside surface of the main portion 29 of the metal part 11 is preferably in the same order of magnitude as the thickness e of its wall.

In practise, this amplitude d of the radial offset of the outside edge 26 forming the anchor edge is at most equal to the thickness e of the wall of the metal part 11.

It is therefore relatively small.

In practise only the outside edge 26 of the end surface 27 of the metal part 11 is engaged in this wedge-like manner in the insulative part 15, and the inside edge 28 of the end surface 27 is not.

The deformed inside end 25 of the metal part 11 faces a transverse shoulder 21 inside the insulative part 15. The inside diameter D1 of the transverse shoulder 21 is less than the inside diameter D2 of the inside edge 28 of the end surface 27 of the deformed inner end 25.

By virtue of provisions put forward elsewhere, a film 30 of adhesive is operative within the housing 20 between the metal part 11 and the insulative part 15.

The adhesive film 30 is confined by the deformed inner end 25 of the metal part 11.

It therefore extends only from the end of the latter opposite the transverse shoulder 21 on the insulative part 15.

Figure 4A:
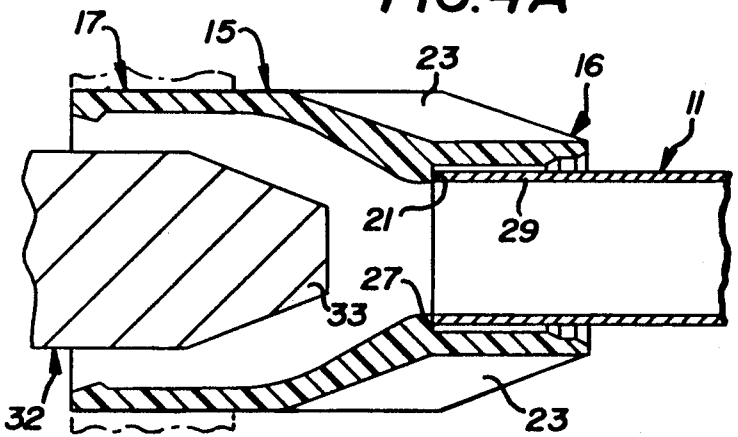
FIGS. 4A and 4B are partial views in cross-section corresponding to FIG. 2 and showing respective and successive stages in the manufacture of the electrical terminal connector in accordance with the invention.

Initially, as already emphasized hereinabove, the metal part 11, whose wall thickness e is in practise uniform over all its length, is globally straight (FIG. 4A).

It is then inserted into the housing 20 formed by the section 16 of the insulative part 25 until its end surface 27 butts against the internal transverse shoulder 21 delimiting the housing 20.

By virtue of provisions put forward elsewhere the metal part 11 is appropriately centered in the insulative part 15 and its inside surface is continuous with the inside surface of the latter.

As shown in FIG. 4A, there is then inserted into the rear section 17 of the insulative part 15, from the end thereof opposite the metal part 11, a punch 32 whose active part 33 is globally frustoconical.

Figure 4B:
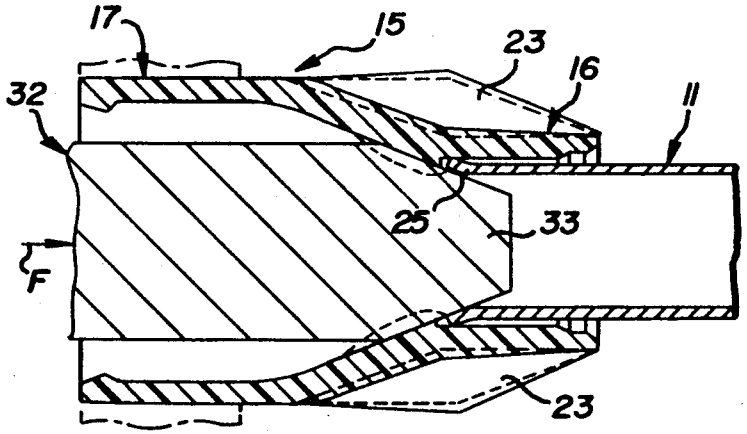

The insertion of the punch 32 continues until its active part 33 contacts the inner end 25 of the metal part 11 and until, the corresponding axial force F being made sufficient to this end, it causes the required tulip-shaped deformation of the inner end 25, as schematically represented in FIG. 4B, with conjoint elastic deformation of the insulative part 15, as also schematically represented in FIG. 4B.

To facilitate its action the punch 32 may be rotated about its axis.

Be this as it may, the result of the deformation that it applies to the inner end 25 of the metal part 11 is to anchor the latter into the insulative part 15.

After the punch 32 is withdrawn the insulative part 15 returns elastically to its initial configuration while the deformed inner end 25 of the metal part 11 may undergo a more moderate elastic "rebound".

This anchoring may be done before the application of the adhesive film 30.

As emphasized hereinabove, this advantageously results in confinement of the adhesive on the side of the deformed inner end 25 of the metal part 11 opposite the transverse shoulder 21 on the insulative part 15.

As an alternative to this, however, the anchoring in accordance with the invention may be performed after the application of the adhesive film 30, being then in practise carried out before polymerization of the corresponding adhesive.

The present invention is not limited to the embodiment described and shown but encompasses any variant execution thereof.

There is claimed:

1. An electrical terminal connector for an insulated electric conductor having a conductive core and insulation covering the core, the connector comprising a generally tubular metal part adapted to fit over a bared end of the conductive core of the insulated electric conductor and an insulative sleeve having a front portion in engagement with said tubular metal part, said front portion having an extreme distal end, said insulative sleeve also having a rear portion of cross section larger than that of said extreme distal end and adapted to fit over a corresponding end of the insulation of the electric conductor, said tubular metal part having a flared in place inner end, said flared inner end having an end surface between radially inside and outside edges, said outside edge being anchored to said insulative sleeve, said insulative sleeve including an interior transverse shoulder having an inside diameter which is less than the diameter of said inside edge of said end surface of said inner end of said tubular metal part, and said inner end of said tubular metal part being in alignment with said transverse shoulder.

2. A connector according to claim 1, wherein said outside edge bites into said insulative sleeve in the manner of a wedge.

3. A connector according to claim 1, wherein said outside edge of said inner end of said tubular metal part is radially outwardly offset from the outside surface of the straight, unflared portion of the tubular metal part the radial offset being of the same order of magnitude as the wall thickness of said tubular metal part.

4. A connector according to claim 3, wherein said radial offset is at most equal to the wall thickness of said tubular metal part.

5. A connector according to claim 1, wherein said inside edge of said end surface of said tubular metal part is out of engagement with said insulative sleeve.

6. A connector according to claim 1, further comprising a film of adhesive between said tubular metal part and said insulative sleeve for bonding said tubular metal part of said insulative.

7. A connector according to claim 6, wherein said film of adhesive is confined by the flared inner end of said tubular metal part.

8. A connector according to claim 1, wherein the wall thickness of said tubular metal part is uniform over the entire length thereof.

* * * * *